US007490540B2

(12) United States Patent
Schwarzkopf

(10) Patent No.: US 7,490,540 B2
(45) Date of Patent: Feb. 17, 2009

(54) RECIPROCATING COMPRESSOR, IN PARTICULAR $CO_2$ COMPRESSOR FOR VEHICLE AIR-CONDITIONING UNITS

(75) Inventor: Otfried Schwarzkopf, Magstadt (DE)

(73) Assignee: Zexel Valeo Compressor Europe GmbH, Ludwigsburg (DE)

( * ) Notice: Subject to any disclaimer, the term of this patent is extended or adjusted under 35 U.S.C. 154(b) by 679 days.

(21) Appl. No.: 10/817,152

(22) Filed: Apr. 2, 2004

(65) Prior Publication Data

US 2004/0216603 A1 Nov. 4, 2004

(30) Foreign Application Priority Data

Apr. 4, 2003 (DE) ..... 103 15 477

(51) Int. Cl.
*F01B 3/02* (2006.01)

(52) U.S. Cl. ..... 92/12.2

(58) Field of Classification Search ..... 92/12.2; 91/505; 74/839
See application file for complete search history.

(56) References Cited

U.S. PATENT DOCUMENTS 2,964,234 A * 12/1960 Loomis ..... 74/831
6,164,252 A * 12/2000 Kuhn et al. ..... 123/56.3

FOREIGN PATENT DOCUMENTS

| | | |
|---|---|---|
| DE | 44 11 926 C2 | 10/1994 |
| DE | 197 49 727 | 10/1999 |
| DE | 100 10 132 A1 | 4/2001 |
| EP | 1 172 557 A2 | 1/2002 |
| FR | 2 782 126 | 2/2000 |
| WO | WO 02/38959 A1 | 5/2002 |

* cited by examiner

*Primary Examiner*—F. Daniel Lopez
(74) *Attorney, Agent, or Firm*—Andrus, Sceales, Starke & Sawall, LLP

(57) ABSTRACT

Reciprocating compressor (100), in particular $CO_2$ compressor for vehicle air-conditioning units, with a swivel disk (107), in particular annular in form, that is rotated by a drive shaft (104) and can be positioned at an adjustable angle with respect to the drive shaft (104), wherein said disk is connected in an articulated manner to a sliding sleeve (108) that can be moved axially along the drive shaft (104) as well as to at least one supporting element (109) so disposed that it is spaced apart from the drive shaft (104) and rotates therewith, and wherein each of the pistons (106) comprises a joint arrangement (110) with which the swivel disk (107) is in sliding engagement. The articulated connection (116) between drive shaft (104) and swivel disk (107) serves substantially only to transmit torque, whereas the supporting element (109) serves substantially only to provide axial support to the pistons (106) and hence to absorb the force exerted by the gas.

1 Claim, 5 Drawing Sheets

RECIPROCATING COMPRESSOR, IN PARTICULAR $CO_2$ COMPRESSOR FOR VEHICLE AIR-CONDITIONING UNITS

CROSS REFERENCE TO RELATED APPLICATION

The present application claims priority from German Application No. 103 15 477.9 filed on Apr. 4, 2003.

DESCRIPTION

The invention relates to a reciprocating compressor, in particular a $CO_2$ compressor for vehicle air-conditioning units, according to the precharacterizing clause of claim 1.

A reciprocating compressor of this kind is known, for example, from the German patent DE 197 49 727 A1. This compressor comprises a case within which are disposed a plurality of pistons arranged in a circle around a rotating drive shaft. The driving force is transmitted from the drive shaft to an annular swivel disk by way of a driver, and in turn is transmitted from the disk to the pistons, translational movement of which is parallel to the drive shaft. The annular swivel disk is pivotably mounted on a sleeve that is mounted on the shaft so as to be slidable in the axial direction. Within this sleeve a slot is provided, through which the said driver engages the disk. The extent to which the sleeve can slide along the drive shaft is thus limited by the dimensions of the slot. The apparatus is assembled by installing the driver so that it projects through the slot. Drive shaft, driver, sliding sleeve and swivel disk are disposed in a so-called drive space where the pressure can vary. The volume displaced, and hence the transport efficiency of the compressor, depend on the relation between the pressures on the suction side and the pressure side of the pistons or, correspondingly, on the pressures in the cylinders on one hand and in the drive space on the other hand.

The said driver serves to transmit torque between drive shaft and swivel disk as well as to provide axial support for the pistons, i.e. to absorb the force of the gas. The construction according to DE 197 49 727 A1 is based on an older construction, for instance according to DE 44 11 926 A1, in which the driver consists of two parts; a first driver part attached to the drive shaft is disposed next to the swivel disk, at a considerable distance therefrom, and a second driver part, in articulated engagement with the first part, constitutes a lateral projection from the swivel disk. This construction has the disadvantage that it is crucially involved in determining the minimal axial length of the compressor. Furthermore, the swivel disk with its thickened hub region has a relatively large moment of inertia because of its lateral projection, combined with a center of gravity a considerable distance away from the drive axis, so that a sudden change in rotational velocity with corresponding inertia results in an undesired tilting of the swivel disk. Furthermore, because the center of gravity is far from the tilt axis, the drive mechanism is put out of balance, because it can be balanced only for a (preferably) mean angle of swivel-disk tilt. Similar considerations apply to the construction according to EP 1 172 557 A2.

In comparison to these known constructions, the one proposed according to DE 197 49 727 is distinguished by being considerably more compact. Inertial forces are reduced to a minimum. Furthermore, this construction also ensures that the inner dead-point position of the pistons is maintained precisely; so-called gap spaces are prevented. A preferred embodiment according to DE 197 49 727 will now be described in detail with reference to FIGS. 10 and 11. A reciprocating compressor 1 as shown in FIG. 10 comprises, for example, seven pistons 2, which are arranged circumferentially at equal angular distances from one another and are seated in cylindrical bores 3 in a cylinder block 4 so that they can move back and forth in the axial direction. The stroke of the pistons 2 is brought about by engagement with an annular swivel disk 6, which is tilted at an angle with respect to a drive shaft 5, by way of engagement chambers 7 in said disk each of which is adjacent to a closed cavity 8 in the associated piston 2. To provide a sliding engagement that is substantially free of play at every angle to which the swivel disk 6 is tilted, between the disk and a spherically curved inner wall 10 of the engagement chamber 7, sliding blocks 11, 12 in the form of spherical segments or the like are disposed bilaterally, so that the swivel disk 6 slides between them during its rotation. The driving force is transmitted from the drive shaft 5 to the swivel disk 6 by way of a driver 13, which is attached to the drive shaft 5 and ends in a (e.g., spherical) head 15 that engages a radial bore 16 in the disk 6. The position of the driver head 15 is chosen in such a way that its center 17 coincides with that of the sphere of which the spherical segments 11, 12 are a part. Its center is also located on a circle interconnecting the geometrical axes of the seven pistons. As a result, the dead-point position of the pistons 2 is precisely determined and a minimum of exhaust space is ensured.

The head shape of the free driver end makes it possible to change the tilt angle of the annular disk 6, in that the driver head 15 forms a bearing body about which the disk 6 pivots, making a tilting movement that alters the stroke magnitude of the pistons 2. Another prerequisite for tilting of the disk 6 is that its bearing spindle 20 must be able to move along the drive shaft 5. For this purpose, as shown in FIG. 11, the bearing spindle 20 is formed by two equiaxial bearing pins 22, 23 mounted on either side of a sliding sleeve 21 and also seated in radial bores 24, 25 of the annular disk 6. For this purpose the sliding sleeve 21 has preferably bilateral bearing sleeves 26, 27, which form a bridge between the sliding sleeve 21 and the annular disk 6. The distance over which the bearing spindle 20 can move, and hence the maximal tilt of the swivel disk 6, is limited by the driver bolt 13, which extends through a slot 30 provided in the sliding sleeve 21, and thus stops the latter's movement when the driver abuts against either end of the slot 30. The force required to change the angle of the swivel disk 6 and thereby control the compressor is given by the sum of the two pressures acting against one another on either side of the piston 2; therefore this force depends on the pressure in the drive space 33. To control the drive-space pressure, a connection can be provided through which gas can flow from an external pressurized source. The higher the pressure on the drive-space side of the pistons 2, i.e. in the drive space 33, compared with the pressure on the opposite side of the pistons 2, the shorter will be the stroke of the pistons 2 and consequently the lower the efficiency of the engine. The position of the sliding sleeve 21, and consequently the piston stroke and the efficiency of the compressor, is adjusted by means of at least one spring 34, 35 that cooperates with the sliding sleeve 21. The sliding sleeve 21 is preferably enclosed between two helical compression springs 34, 35 disposed on the drive shaft 5.

A disadvantage of the known construction is that because of the principle according to which the driver contacts the swivel disk, the deformation produced in the disk is not the same on both sides, and therefore the way in which the disk runs along the sliding blocks becomes unfavorable. In the vicinity of the cylindrical bore in the swivel disk within which the spherical end of the driver is supported, this construction leaves only a very thin wall remaining, so that this region becomes severely deformed. Hence the running properties of the sliding blocks along the swivel disk are correspondingly impaired. This problem has been recognized previously. A means of avoiding it is proposed, for example, in WO 02/38959 A1, namely a difference between the geometrical shapes of driver and associated bore.

The patent FR 2 782 126 A1 discloses another swivel-disk drive mechanism in which a driver projects into a swivel disk. Unlike the state of the art according to DE 197 49 727 A1, however, this swivel disk is also coupled in the radial direction and therefore cannot be displaced radially. The advantage of this construction is that the associated joint can transmit forces over an area, and consequently enables a relatively compact construction.

In summary, however, it can be concluded that all of the known constructions suffer from the disadvantages discussed below, in particular because of the superposition of multiple functions:

- to transmit the driving force (by way of driver/torque support) and also
- to support the swivel disk in such a way that the top-dead-center point of the piston remains unchanged.

This produces the following behavior:

- both of these influences subject the head of the driver, which as a rule is spherical, to considerable surface pressure in two regions;
- this surface pressure also appears at the corresponding places on the swivel disk;
- as a result of these surface pressures deformations can easily occur, which can influence one another in an uncontrolled manner, depending on the circumstances.

Impinging on the known driver/torque support are both the torque and the reactive force exerted by the swivel disk to support resulting gas forces. Both force and bending moment are maximal in the region of the seating on the drive shaft. Hence the drive shaft must have correspondingly large dimensions, and of course this also applies to the dimensioning of both the driver and the swivel disk, especially in the region of the bore in which the driver is seated. The larger dimensions inevitably result in correspondingly higher masses and hence moments of inertia. These can unfavorably influence the regulatory behavior and must be compensated. Another result of the larger dimensions is that the joint arrangements associated with the pistons are larger or must be made larger. This applies to the sliding blocks as well as to the pistons themselves.

To remedy this situation, measures must be taken to reduce the impinging forces.

Accordingly it is the objective of the present invention to create a compressor of the kind cited above that can have a more lightweight construction without restricting its functional reliability.

This objective is achieved in accordance with the invention by the characterizing features given in claim 1. That is, the central idea of the present invention is to avoid the functional superposition present in the state of the art, namely

- to support the gas force, as well as
- to transmit torque in the region between swivel disk and drive shaft. That is, these functions are uncoupled, so that the demands placed on the individual components for transmitting the said forces and moments are reduced and hence the components can be made smaller. In particular, it is also possible for tolerances between the individual components to be adjusted more precisely, and excessive surface pressures can be avoided. In accordance with the invention, therefore, the axial support of the pistons on one hand and the transmission of torques from the drive shaft to the swivel disk on the other hand are assigned to different components.

It has proved useful to transmit the torque by way of the swivel joint between disk and drive shaft, especially in view of the fact that as a rule two pin joints are provided for the purpose. The amount of play in this pin suspension can be precisely adjusted, and pressure points can be avoided. Hence in accordance with the invention a superposition of circumferential and axial forces in the region between supporting element and swivel disk is prevented.

Preferred embodiments and structural details of the solution in accordance with the invention are described in the subordinate claims.

In the following, concrete embodiments of the construction in accordance with the invention are described in detail with reference to the attached drawings, wherein FIG. 1 shows a first embodiment of a compressor in accordance with the invention in schematic longitudinal section;

Figure 1:
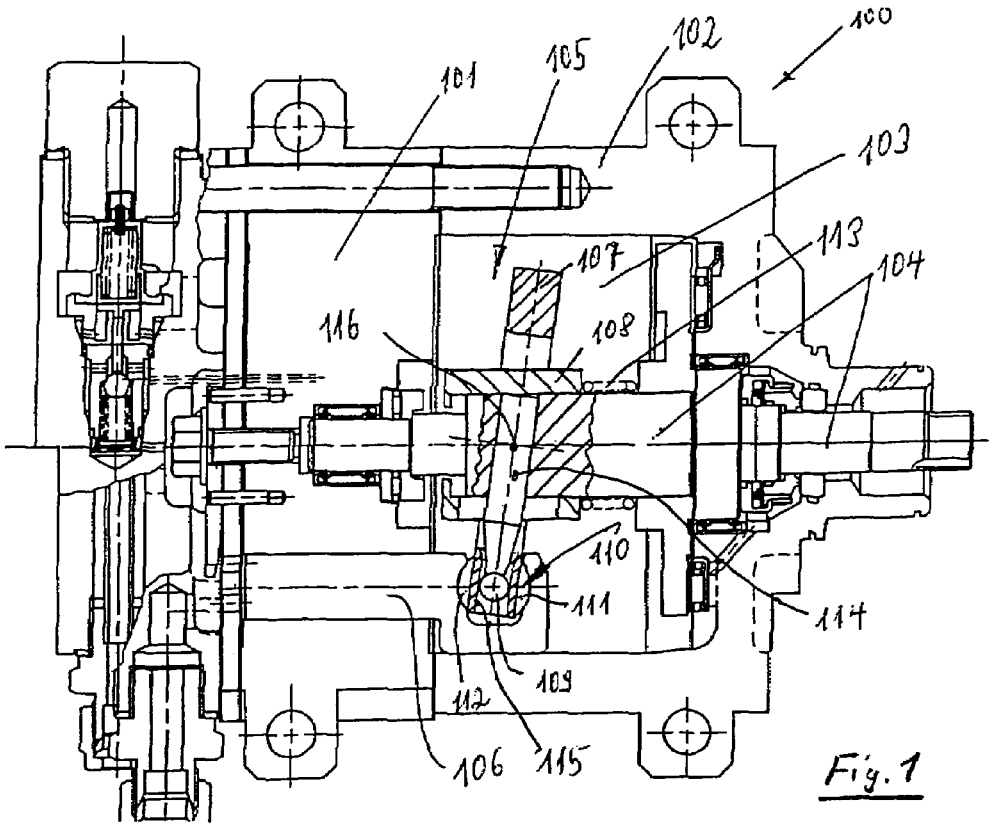

The compressor 100 shown schematically in longitudinal section in FIG. 1 comprises a cylinder block 101, a case 102 enclosing a drive space 103, and a drive shaft 104 that by way of a swivel-disk mechanism 105 within the drive space 103 drives several, in particular seven pistons 106, which are disposed at uniform distances from one another around the drive shaft 104 and are seated within the cylinder block 101 so as to be axially movable.

The swivel-disk mechanism 105 comprises an annular swivel disk 107, which is movably connected both to a sliding sleeve 108 mounted on the drive shaft 104 so as to be axially displaceable and to a supporting element 109 disposed so that it is spaced apart from the drive shaft 104 and rotates therewith. Each of the pistons 106 comprises a joint arrangement 110 with which the annular swivel disk 107 is in sliding engagement. The joint arrangement 110 is constructed according to the state of the art and comprises two hemispherical sliding blocks 111, 112.

The sliding sleeve 108 is likeweise constructed according to the state of the art, and is placed under axial tension by helical compression springs 113.

The supporting element 109 in the embodiment illustrated here has the form of a spherical head. It is situated at the free end of a rod-like force-transmission element 114. The supporting element 109 engages a slot 115 on the annular swivel disk 107, specifically on the annular element thereof; the axis of the bore that forms this slot extends radially and the longer, cross-sectional axis of the bore extends in the circumferential direction. This arrangement ensures that the supporting element 109 serves essentially only to provide axial support for the piston 106, helping it to withstand the force exerted by the gas. The associated forces are transmitted to the drive shaft 104 by way of the supporting element and the rod 114 connected thereto. The transmission of torque between drive shaft 104 and swivel disk 107 is achieved exclusively by an articulated connection 116 disposed between them (see FIGS. 2 to 5). The supporting element 109, rather than being spherical, can also have the shape of a cylinder or barrel. In the last two cases the long axis of the supporting element extends perpendicular to the rod-like force-transmission element 114. This embodiment has the advantage that the axial support is brought about by a linear contact between supporting element and the associated radial bore in the swivel disk 107.

Because the transmission of torque is uncoupled from support against the force exerted by gas, it is possible to make the swivel disk relatively small and correspondingly lightweight in structure, without the occurrence of deformations. It is also simpler to construct the force-transmitting means without allowance for play, with the consequence that the compressor makes less noise during operation.

The tilting articulation 116 between drive shaft 104 and swivel disk 107 can be variously constructed, as can be seen in FIGS. 2 to 5. These figures also make clear that the supporting element 109 within the slot 115 has sufficient play in the circumferential direction, i.e. the direction of rotation, that forces associated with the driving torque can never have an effect. The only forces absorbed and transmitted by the supporting element are the axial forces exerted by gas.

Figure 2:
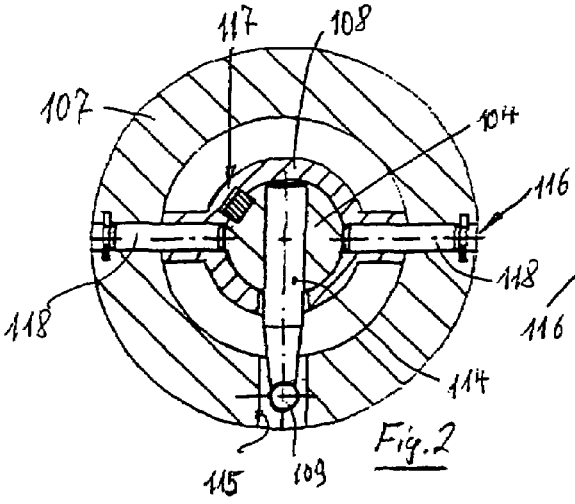
FIGS. 2 to 5 show schematically in cross section various embodiments of the articulated connection between drive shaft and swivel disk, while simultaneously showing how the swivel disk is axially braced against the drive shaft.

In the embodiment according to FIG. 2 the transmission of torque between drive shaft 104 and annular swivel disk 107 is mediated by two pins extending diametrically relative to the drive shaft 104 and acting between the sliding sleeve 108 and the swivel disk 107. The sliding sleeve itself is nonrotatably connected to the drive shaft 104 by way of a feather-key arrangement 117. The annular swivel disk 107 can be pivoted about the axis defined by said bearing pins 118. The rod-like force-transmission element 114 extends through the sliding sleeve 108 with some clearance.

Figure 3:
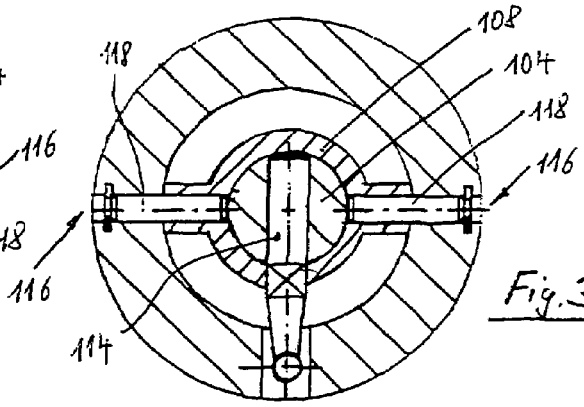

In the embodiment according to FIG. 3 it is the rod-like force-transmission element 114 that prevents the sliding sleeve 108 from rotating out of position with respect to the drive shaft 104. In other respects the construction according to FIG. 3 is the same as that shown in FIG. 2.

Figure 4:
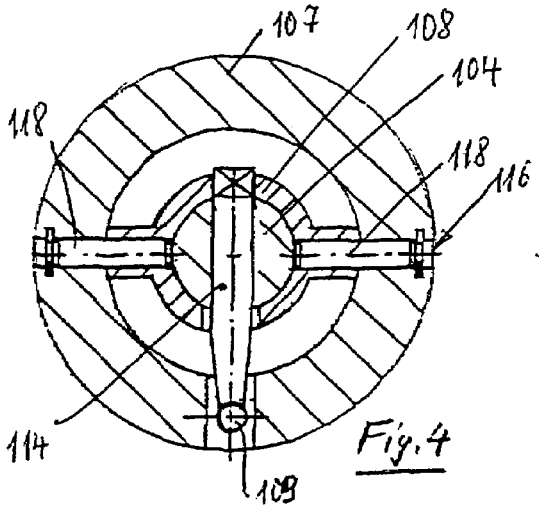

The embodiment according to FIG. 4 corresponds substantially to that according to FIG. 3; in the embodiment shown in FIG. 4, displacement between the drive shaft 104 and sliding sleeve 108 is likewise prevented by the force-transmission rod 114. In the embodiment according to FIG. 4, however, the coupling is brought about exclusively at the end of the force-transmission rod 114 opposite to the spherical supporting element 109.

Figure 5:
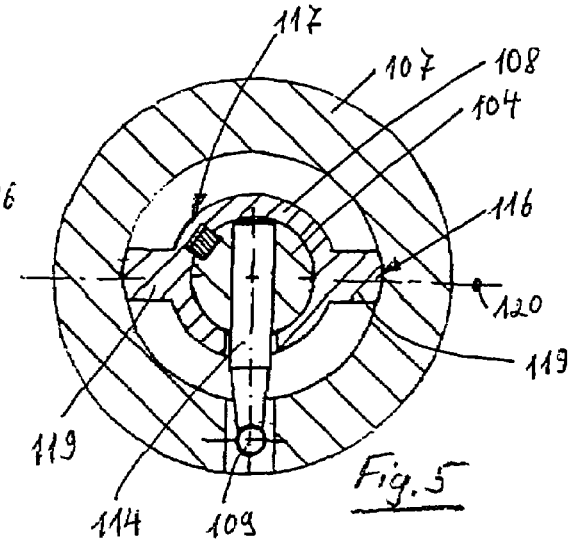

FIG. 5 shows another means of connecting the drive shaft 104 to the annular swivel disk 107, in this case with no intervening bearing pins 118. These have been replaced by corresponding radial pegs 119 associated with the sliding sleeve 108 in the embodiment according to FIG. 5. These radial pegs 119 constitute a bearing upon which the annular swivel disk 107 can rotate about a transverse axis 120 defined by the radial pegs 119. In other respects the construction according to FIG. 5 corresponds to that according to FIG. 2.

Figure 6:
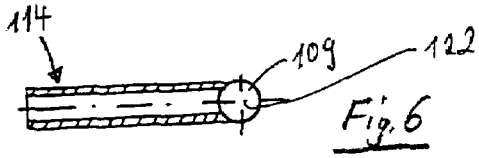
FIGS. 6 and 7 show two different embodiments of an element to transmit axial force between swivel disk and drive shaft, in longitudinal section and in side view.
Figure 7:
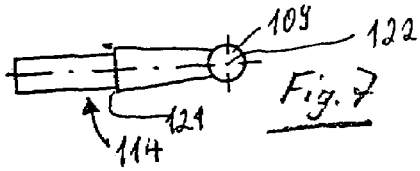

FIGS. 6 and 7 show two different embodiments for the connection between a spherical supporting element 109 and a rod-like force-transmission element 114. In the embodiment according to FIG. 6 the spherical supporting element 109 is disposed at one end of a sleeve-like force-transmission element 114, in particular is welded thereto (preferably by a friction-welded connection).

In the exemplary embodiment according to FIG. 7 the rod-like force-transmission element 114 additionally comprises a circumferential shoulder 121 that serves as an abutment during insertion into a receiving bore formed in the drive shaft 104. The rod-like force-transmission element 114 in the embodiment according to FIG. 1 is disposed so that it extends away from the drive shaft 104 at an angle, in such a way that when the annular swivel disk 107 is tilted to an intermediate position, the long axis of the rod-like force-transmission element 114 is oriented radially with respect to the annular swivel disk 107.

The above-mentioned abutment 121 also ensures that the center 122 of the spherical supporting element 109 coincides with the midpoint of the joint arrangement 110 associated with each piston, with no need for additional adjustments during assembly of the compressor. This installed position is preferred; however, it can also be advantageous to provide a slight "offset" amounting to as much as about 1/10 mm between the circle on which the center of the supporting element 109 lies and the circle passing through the midpoints of the joint arrangements 110, so that the exhaust space will vary slightly depending on the tilt angle. Preferably the center 122 of the supporting element 109 is situated on a circle that extends radially slightly beyond the circle on which the midpoints of the piston-joint arrangements 110 lie. This embodiment has the advantage that the swivel disk is at no time subjected to tilting forces that would tilt it in another, unintended direction.

At this juncture it should once again be mentioned that it is conceivable to provide two so-called gas-force supports or supporting elements 109, which provide support in axially opposite directions. By this means it is possible to avoid a so-called double fitting, with the problem of overspecification. The two supporting elements can also be asymmetrically disposed.

In the case of a single gas-force support, it could support the swivel disk shortly ahead of the upper top-dead-center position, because in this position the force is maximal owing to opening of the valve. In such a variant, however, care must be taken that the center of the supporting element continues to coincide with the midpoint of the piston-joint arrangement 110. It should also be noted that when the joint is positioned ahead of top dead center, the swivel disk is somewhat thinner-walled on its most heavily loaded (pressure) side than on the opposite (pulling) side.

Figure 8:
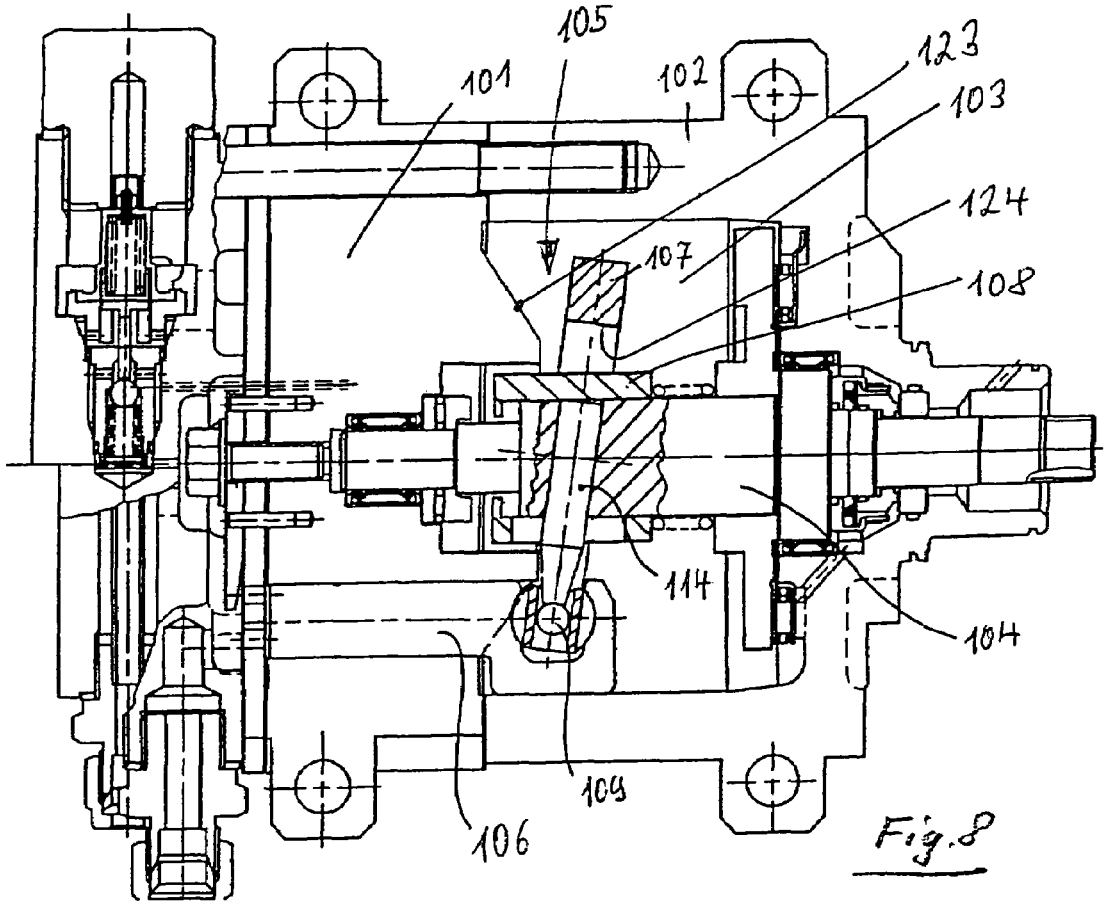
FIG. 8 shows a second exemplary embodiment of a compressor constructed in accordance with the invention, in schematic longitudinal section.

FIG. 8 shows another exemplary embodiment of a compressor in accordance with the invention, in which the parts already described with reference to FIG. 1 are identified by the same numerals as in FIG. 1.

The swivel-disk mechanism 105 here is identical to that in FIG. 1, so that essentially the only feature differing from FIG. 1 in the exemplary embodiment according to FIG. 8 is the configuration of the cylinder block 101, which extends conically into the driving space 103 and hence provides a longer guide region for the piston 106. The cone 123 is constructed so that it extends into the annular space 124 between sliding sleeve 108 and annular swivel disk 107. By thus reducing the length of the compressor, its overall size can be additionally reduced.

Figure 9:
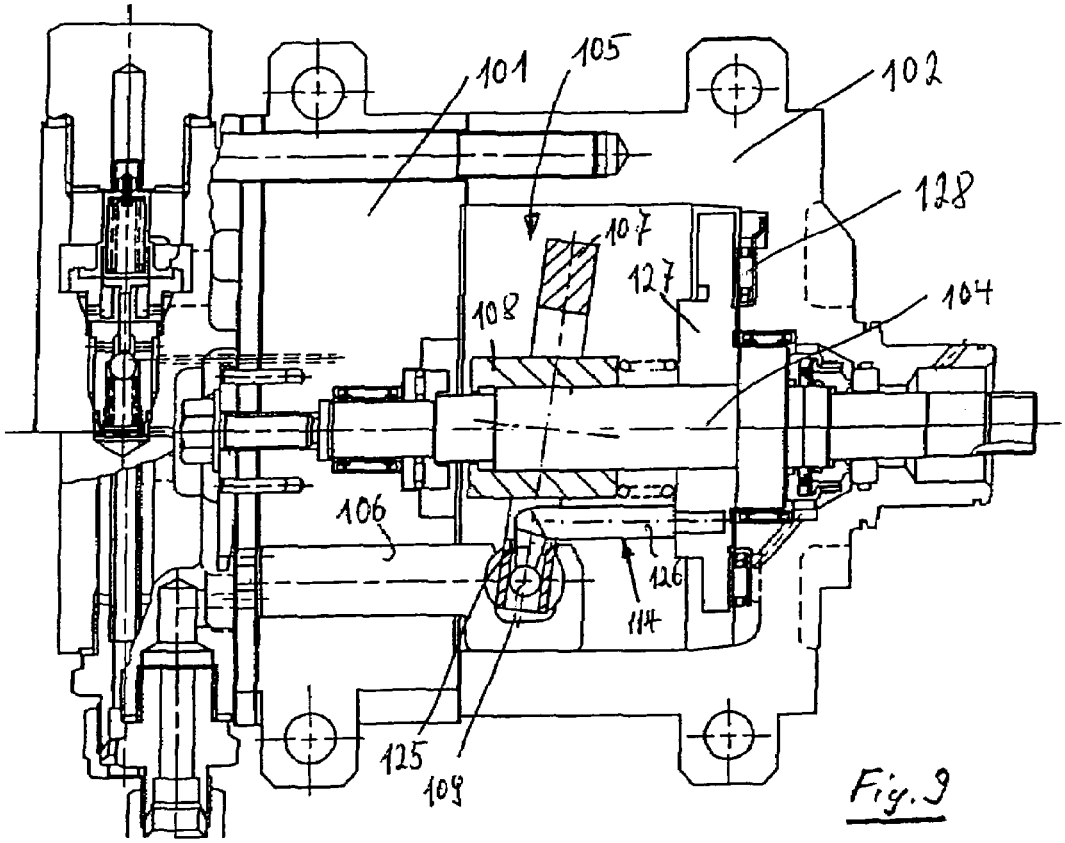
FIG. 9 shows another exemplary embodiment of a compressor constructed in accordance with the invention, in schematic longitudinal section
Figure 10:
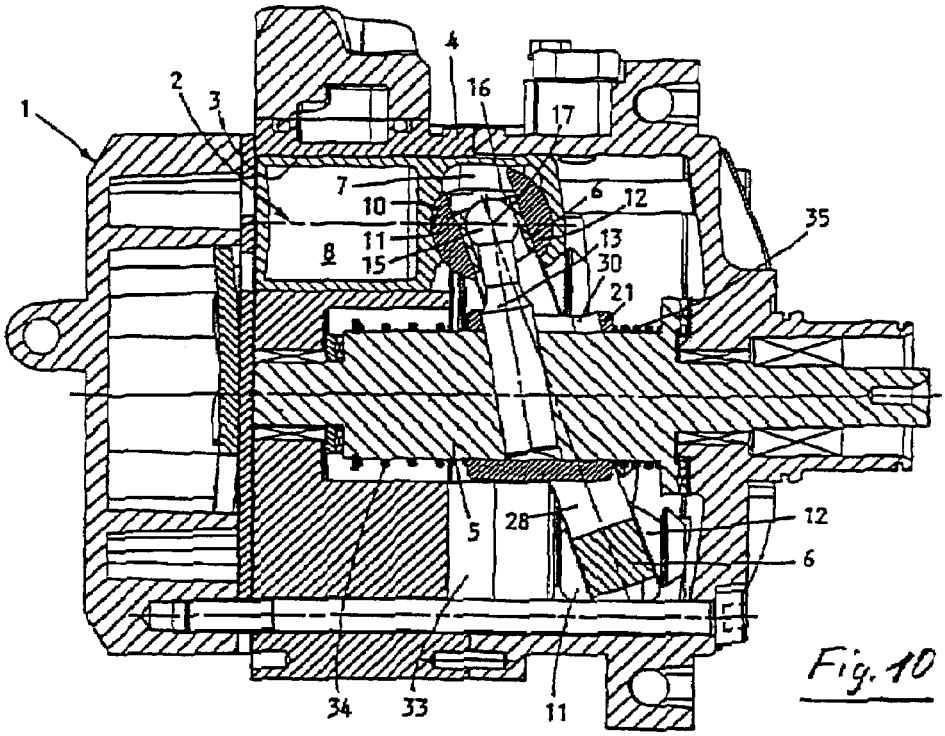
Fig. 10 PRIOR ART
FIGS. 10 and 11 illustrate prior art.
Figure 11:
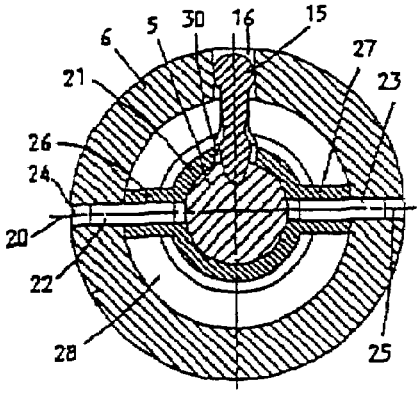
Fig. 11 PRIOR ART

In the embodiment according to FIG. 9 the supporting element 109 is disposed at the free end of an L-shaped force-transmission element 114, namely at the free end of the short limb 125, which is angled so as to extend radially outward. The longer limb 126 extends approximately parallel to the drive shaft 104 and is axially braced against a bearing plate 127, which is nonrotatably connected to the drive shaft 104. The bearing plate 127 in turn is supported by way of a needle bearing 128 on the case 102, which extends around the drive shaft 104.

This construction has the advantage of avoiding the need to construct a bore in the drive shaft 104 to serve as bearing for the rod-like force-transmission element 114. Accordingly, the diameter of the drive shaft 104 can be greatly reduced.

FIG. 9 also makes clear that the so-called gas-force support could alternatively engage the swivel disk from outside rather than from inside, in which case the device that keeps the piston from rotating out of position would not be disposed on the inner side of the drive-space case 102, but instead is shifted inward, toward the drive shaft.

All the characteristics disclosed in the application documents are claimed as essential to the invention insofar as they are new to the state of the art individually or in combination.

LIST OF REFERENCE NUMERALS

100 Compressor
101 Cylinder block
102 Case
103 Drive space
104 Drive shaft
105 Swivel-disk mechanism
106 Piston
107 Swivel disk (annular)
108 Sliding sleeve
109 Supporting element
110 Joint arrangement
111 Sliding block
112 Sliding block
113 Helical compression spring
114 Force-transmission element (rod-like)
115 Slot
116 Joint connection
117 Feather-key arrangement
118 Bearing pin
119 Radial peg
120 Transverse axis
121 Circumferential shoulder or abutment
122 Center of the supporting element
123 Cone
124 Annular space
125 Limb
126 Limb
127 Bearing plate
128 Needle bearing

The invention claimed is:

1. A reciprocating piston compressor (100), comprising a swivel disk (107) having an annular shape, that is rotated by a drive shaft (104) and is positioned at an adjustable angle with respect to said drive shaft (104), said swivel disk (107) connected in an articulated manner to sliding sleeve (108) that is selectively moved axially along said drive shaft (104) as well as to at least one rounded supporting element (109) so disposed that it is spaced apart from and connected to said drive shaft (104) by way of a L-shaped rod-like force transmission element (114) having a free end connected to said supporting element (109) and having a limb (126) extending approximately parallel to said drive shaft (104) and supported axially against a bearing plate (127), and rotates therewith, a piston (106) comprises a joint arrangement (110) with which said swivel disk (107) is in sliding engagement, said swivel disk (107) having a slot (115) disposed proximate its circumferential edge, said slot (115) having a radial axis and a longer axis perpendicular to said radial axis with a portion of said supporting element (109) disposed within said slot (115), whereby the articulated connection (116) between drive shaft (104) and swivel disk (107) serves substantially only to transmit torque, and said supporting element (109) serves substantially only to provide axial support to said piston (106) and hence to absorb the force exerted by the gas.

* * * * *